US008936349B2

(12) United States Patent
Otake

(10) Patent No.: US 8,936,349 B2
(45) Date of Patent: Jan. 20, 2015

(54) IMAGE FORMING APPARATUS

(71) Applicant: Seiko Epson Corporation, Tokyo (JP)

(72) Inventor: Masahisa Otake, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/037,970

(22) Filed: Sep. 26, 2013

(65) Prior Publication Data

US 2014/0085364 A1 Mar. 27, 2014

(30) Foreign Application Priority Data

Sep. 27, 2012 (JP) ..... 2012-213712
Oct. 15, 2012 (JP) ..... 2012-227711
Aug. 12, 2013 (JP) ..... 2013-167340

(51) Int. Cl.
*B41J 2/145* (2006.01)
*B41J 11/00* (2006.01)
*B41J 2/21* (2006.01)

(52) U.S. Cl.
CPC ..... *B41J 11/008* (2013.01); *B41J 2/2132* (2013.01); *B41J 11/002* (2013.01)
USPC ..... 347/41; 347/102

(58) Field of Classification Search
USPC ..... 347/102, 41, 12, 15, 43
See application file for complete search history.

(56) References Cited

U.S. PATENT DOCUMENTS 8,657,435 B2 * 2/2014 Usuda et al. ..... 347/102
2010/0194838 A1 8/2010 Mitsuzawa
2011/0085013 A1 4/2011 Onishi et al.

FOREIGN PATENT DOCUMENTS

JP 2004-042548 2/2004
JP 2004-291414 10/2004
JP 2005-199563 7/2005
JP 2007-160528 6/2007
JP 2010-179537 8/2010
JP 2011-083915 4/2011

* cited by examiner

*Primary Examiner* — Lamson Nguyen
(74) *Attorney, Agent, or Firm* — Workman Nydegger

(57) ABSTRACT

An image forming apparatus forming an image on a recording medium includes a head unit which includes an ejecting unit which ejects photo-curable color ink which is cured by being irradiated with light, an ejecting unit which ejects photo-curable transparent ink which is cured by being irradiated with light, and a light irradiation unit which radiates the light; a moving unit which moves the recording medium and the head unit relatively in reciprocating movements; and a controller which causes the transparent ink to be ejected toward the recording medium while causing the head unit to move in one direction in the reciprocating movements, and causes the transparent ink which is applied in the one direction to be irradiated with the light while causing the head unit to be moved in the other direction in the reciprocating movements.

5 Claims, 10 Drawing Sheets

IMAGE FORMING APPARATUS

BACKGROUND

1. Technical Field

The present invention relates to an image forming apparatus.

2. Related Art

There is a case in which, for example, when forming an image on a recording medium not having an ink absorbing layer using photo-curable ink, since ink is not absorbed in the recording medium, an image with irregularity on the surface is formed, and an image quality thereof is deteriorated. Therefore, in the related art, an image forming apparatus including a head which ejects photo-curable color ink, a head which ejects photo-curable transparent ink, a light irradiation unit which radiates light with respect to the ejected ink, and a controller which controls an irradiation amount of light which is radiated from the light irradiation unit according to an image quality has been known (for example, refer to JP-A-2005-199563).

However, since it is necessary to control the light irradiation unit according to an image quality, in the above described image forming apparatus, there has been a problem in that a configuration of the apparatus becomes complicated, and it is not possible to easily control irregularity of the image quality.

SUMMARY

The invention can be realized in the following forms or application examples.

APPLICATION EXAMPLE 1

According to this application example, there is provided an image forming apparatus which forms an image on a recording medium, and includes a head unit which includes an ejecting unit which ejects photo-curable color ink which is cured by being irradiated with light, an ejecting unit which ejects photo-curable transparent ink which is cured by being irradiated with light, and a light irradiation unit which radiates the light, a moving unit which moves the recording medium and the head unit relatively in reciprocating movements, and a controller which causes the transparent ink to be ejected toward the recording medium while causing the head unit to move in one direction in the reciprocating movements, and causes the transparent ink which is applied in the one direction to be irradiated with the light while causing the head unit to be moved in the other direction in the reciprocating movements.

According to the configuration, the transparent ink is applied in a process of moving the head unit in one direction. In addition, light is radiated to the transparent ink in a process of moving the head unit in the other direction. In this manner, the transparent ink is cured. That is, the transparent ink which is applied when moving in the one direction is not cured when the head unit is moved in the one direction, and is cured when the head unit is moved in the other direction. Accordingly, the transparent ink spreads by being wet between concave portions of ink dots of the cured color ink, while the transparent ink is applied onto the recording medium, and is then cured. In addition, the transparent ink is cured in a state of being wet and spread. In this manner, it is possible to easily reduce generation of irregularity on the surface, and to form a high quality image.

APPLICATION EXAMPLE 2

In the image forming apparatus according to the application example, the controller may cause the color ink to be ejected, ink dots to be arranged on the recording medium, and a first ink dot column to be formed, may cause the transparent ink to be ejected, ink dots to be arranged on the recording medium, and a second ink dot column to be formed, and may cause the ink dots of the first ink dot column and the ink dots of the second ink dot column to be arranged by shifting thereof in directions of the first and second ink dot columns.

According to the configuration, since nozzles in a first nozzle column and nozzles in a second nozzle column are arranged by being shifted in directions of the first and second nozzle columns, for example, it is possible to easily arrange the ink dots of the transparent ink between the ink dots of the color ink which are arranged on the recording medium by ejecting color ink while causing the head unit to perform a forward movement. Accordingly, it is possible to effectively reduce generation of irregularity.

APPLICATION EXAMPLE 3

In the image forming apparatus according to the application example, the controller may cause the respective nozzles of the first and second nozzle columns to be arranged so as to have a uniform interval, and may cause the nozzles of the first and second nozzle columns to be arranged so as to be shifted by a distance of a half of the interval between the nozzles in the directions of the first and second nozzle columns.

According to the configuration, the ink dots of the transparent ink are applied to approximately a center portion between the ink dots of the color ink which is applied on the recording medium. Accordingly, it is possible to further effectively fill a concave portion which is formed between the ink dots of the color ink with ink dots of the transparent ink, and to form an image with a surface which is planarized.

APPLICATION EXAMPLE 4

In the image forming apparatus according to the application example, the color ink may be ejected toward the recording medium while moving the head unit in the one direction, and the transparent ink may be ejected toward the recording medium after radiating the light to the color ink which is applied onto the recording medium.

According to the configuration, the color ink is firstly applied in the process of moving the head unit in one direction. Subsequently, the color ink is cured by being irradiated with light. Subsequently, the transparent ink is applied. In addition, the transparent ink is irradiated with light in the process of moving the head unit in the other direction. In this manner, the transparent ink is cured. That is, the transparent ink which is applied in the moving in the one direction is not cured when the head unit is moved in the one direction, and is cured when the head unit is moved in the other direction. Accordingly, the transparent ink spreads by being wet between the concave portion of ink dots of the cured color ink while the transparent ink is applied onto the recording medium, and is then cured. In addition, the transparent ink is cured in a state of being wet and spread. In this manner, it is possible to easily reduce generation of irregularity on the surface, and to form a high quality image.

APPLICATION EXAMPLE 5

In the image forming apparatus according to the application example, the head unit may include a first ejecting unit which ejects photo-curable color ink which is cured by being irradiated with light, second and third ejecting units which eject photo-curable transparent ink which is cured by being irradiated with light, and first and second light irradiation units which radiate the light, the second ejecting unit may be arranged in the direction of the reciprocating movement of the first ejecting unit, a first light irradiation unit may be arranged between the first and second ejecting units, the third ejecting unit may be arranged on a side which is opposite to an arranging position of the second ejecting unit with respect to the first ejecting unit in the direction of the reciprocating movement, and the second light irradiation unit may be arranged between the first and third ejecting units.

According to the configuration, it is possible to arrange the first ejecting unit on an upstream side, arrange the first light irradiation unit on a downstream side of the first ejecting unit, and arrange the second ejecting unit on a downstream side of the first light irradiation unit in one direction of the reciprocating movement. In addition, it is possible to arrange the first ejecting unit on an upstream side, arrange the second light irradiation unit on a downstream side of the first ejecting unit, and arrange the third ejecting unit on a downstream side of the second light irradiation unit in the other direction of the reciprocating movement. In this manner, it is possible to improve productivity since it is possible to form an image in the reciprocating movement.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to drawings. In addition, each member, or the like, is set to a recognizable size in each of the following drawings, and scales of each of the members are denoted by scales which are different from actual scales.

First, a configuration of an image forming apparatus will be described. The image forming apparatus is an image forming apparatus which forms an image on a recording medium, and includes a head unit which includes an ejecting head as an ejecting unit which ejects photo-curable color ink which is cured by being irradiated with light, an ejecting head as an ejecting unit which ejects photo-curable transparent ink which is cured by being irradiated with light, and a light irradiation unit which radiates the light, a moving unit which moves the recording medium and the head unit relatively in reciprocating movements, and a controller which causes the color ink to be ejected toward the recording medium while causing the head unit to move in one direction in the reciprocating movement, causes the transparent ink to be ejected toward the recording medium after causing the color ink which is applied onto the recording medium to be irradiated with light, and causes the transparent ink which is applied in the one direction to be irradiated with light while causing the head unit to be moved in the other direction in the reciprocating movement. Hereinafter, descriptions will be made in detail.

Figure 1:
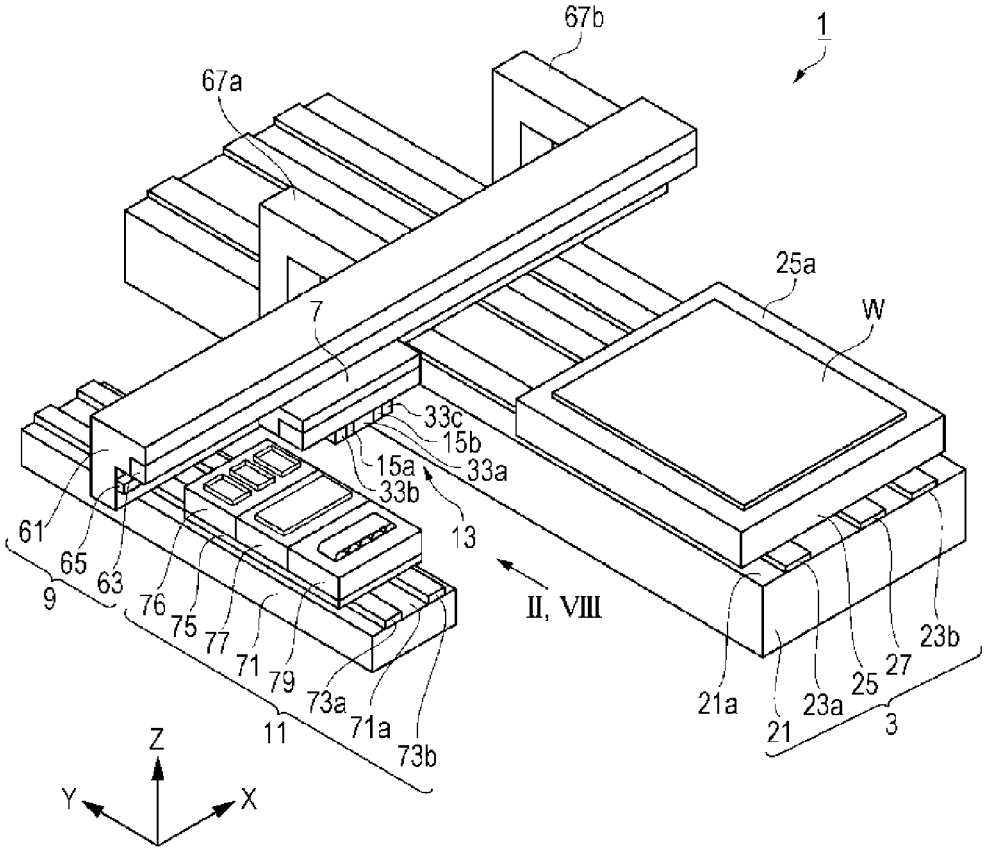
FIG. 1 is a diagram which illustrates an outline of a configuration of an image forming apparatus.

FIG. 1 is a schematic diagram which illustrates a configuration of an image forming apparatus. As illustrated in FIG. 1, an image forming apparatus 1 includes a work transport unit 3, a carriage 7 on which a head unit 13 in which first to third ejecting heads 33*a*, 33*b*, and 33*c* are arranged is mounted, a carriage transport unit 9, a maintenance device 11, and the like. In the image forming apparatus 1, functional liquid is ejected as droplets from the head unit 13 while the head unit 13 and a work W such as a base material are relatively moved. In this manner, the droplets are landed on the work W, and it is possible to form (draw) a desired image. In addition, the Y axis direction in the figure denotes the movement direction of the work W, and the X axis direction denotes a direction which is orthogonal to the Y axis direction when viewed planarly. In addition, a direction which is orthogonal to an XY plane which is defined in the X axis direction and the Y axis direction is defined as the Z axis direction.

The work transport unit 3 includes a surface plate 21, a guide rail 23*a*, a guide rail 23*b*, a work table 25, and a table position detection unit 27. The surface plate 21 is arranged so as to extend along the Y axis direction. The guide rails 23*a* and 23*b* are arranged on a top face 21*a* of the surface plate 21. The guide rails 23*a* and 23*b* respectively extend along the Y axis direction. The guide rails 23*a* and 23*b* are aligned in a state of leaving an interval between each other in the X axis direction.

The work table 25 is provided in a state of facing the top face 21*a* of the surface plate 21 by interposing the guide rails 23*a* and 23*b* therebetween. The work table 25 is mounted on the guide rails 23*a* and 23*b*. The work table 25 includes a mounting surface 25*a* as a surface on which the work W is mounted. The mounting surface 25*a* faces the side (upper side) which is opposite to the surface plate 21 side. The work table 25 is guided along the Y axis direction by the guide rails 23*a* and 23*b*, and is configured so as to perform reciprocating along the Y axis direction on the surface plate 21. A table position detection unit 27 is provided on the top face 21*a* of the surface plate 21, and extends in the Y axis direction. The table position detection unit 27 is provided between the guide rails 23*a* and 23*b*. The table position detection unit 27 detects a position of the work table 25 in the Y axis direction.

The work table 25 is configured so as to perform reciprocating in the Y axis direction by a not shown moving mechanism and a power source. As the moving mechanism, it is possible to adopt a mechanism in which, for example, a ball screw and a ball nut are combined, a linear guide mechanism, or the like. In addition, according to the embodiment, as a power source for moving the work table 25 along the Y axis direction, a work transport motor which will be described later is adopted. As the work transport motor, it is possible to adopt various motors such as a stepping motor, a servomotor, a linear motor, and the like. Power from the work transport motor is transmitted to the work table 25 through a moving mechanism. In this manner, the work table 25 can perform reciprocating movements along the guide rails 23*a* and 23*b*, that is, along the Y axis direction. That is, the work transport unit 3 can cause the work W which is mounted on the mounting surface 25*a* of the work table 25 to perform reciprocating along the Y axis direction.

A carriage transport unit 9 includes a stand 61, a guide rail 63, and a carriage position detection unit 65. The stand 61 extends in the X axis direction, and straddles the work transport unit 3 and the maintenance device 11 in the X axis direction. The stand 61 faces the respective work transport unit 3 and the maintenance device 11, on the side which is opposite to the surface plate 21 side of the work table 25. The stand 61 is supported by posts 67*a* and 67*b*. The posts 67*a* and 67*b* are provided at a position in which the posts face each other in the X axis direction by interposing the surface plate 21 therebetween. The posts 67*a* and 67*b* respectively protrude to the upper part of the work table 25 in the Z axis direction. Due to this, intervals are maintained between the stand 61 and the work table 25, and between the stand 61 and the maintenance device 11, respectively.

The guide rail 63 is provided on the surface plate 21 side of the stand 61. The guide rail 63 extends along the X axis direction, and is provided over the width of the stand 61 in the X axis direction. The carriage 7 is supported by the guide rail 63. In a state in which the carriage 7 is supported by the guide rail 63, nozzle faces 35 of each of the first to third ejecting heads 33*a*, 33*b*, and 33*c* (refer to FIG. 2) face the work table 25 side in the Z direction. The carriage 7 is guided along the X axis direction by the guide rail 63, and is supported by the guide rail 63 in a state of being capable of performing reciprocating in the X axis direction. In addition, the nozzle face 35 and the mounting surface 25*a* of the work table 25 face each other in a state of leaving an interval between each other, in a state in which the carriage 7 is overlapped with the work table 25, when viewed planarly. The carriage position detection unit 65 is provided between the stand 61 and the carriage 7, and extends in the X axis direction. The carriage position detection unit 65 detects a position of the carriage 7 in the X axis direction.

The carriage 7 is configured so as to perform reciprocating in the X axis direction by a not shown moving mechanism and a power source. As the moving mechanism, it is possible to adopt a mechanism in which, for example, a ball screw and a ball nut are combined, a linear guide mechanism, or the like. In addition, according to the embodiment, as a power source for moving the carriage 7 along the X axis direction, a carriage transport motor as a moving unit which will be described later is adopted. As the carriage transport motor, it is possible to adopt various motors such as a stepping motor, a servomotor, a linear motor, and the like. Power from the carriage transport motor, is transmitted to the carriage 7 through the moving mechanism. Due to this, the carriage 7 can perform reciprocating along the guide rail 63, that is, along the X axis direction. That is, the carriage transport unit 9 can cause the head unit 13 which is supported by the carriage 7 to perform reciprocating along the X axis direction.

The maintenance device 11 includes a surface plate 71, guide rails 73*a* and 73*b*, a maintenance table 75, a capping unit 76, a flushing unit 77, and a wiping unit 79. The surface plate 71 is provided at a position which faces the surface plate 21 by interposing the post 67*a* therebetween in the X axis direction. The guide rails 73*a* and 73*b* are arranged on a top face 71*a* of the surface plate 71. The respective guide rails 73*a* and 73*b* extend along the Y axis direction. The guide rails 73*a* and 73*b* are aligned in a state of leaving an interval between each other in the X axis direction. The maintenance table 75 is provided in a state in which the table faces the top face 71*a* of the surface plate 71 by interposing the guide rails 73*a* and 73*b* therebetween. The maintenance table 75 is mounted on the guide rails 73*a* and 73*b*.

Maintenance units such as the capping unit 76, the flushing unit 77, and the wiping unit 79 are mounted on the maintenance table 75. The maintenance table 75 is guided along the Y axis direction by the guide rails 73*a* and 73*b*, and is configured so as to perform reciprocating along the Y axis direction on the surface plate 71. The flushing unit 77 is provided on a side which is opposite to the surface plate 71 side of the maintenance table 75. Here, the operation of ejecting functional liquid from the first to third ejecting heads 33*a*, 33*b*, and 33*c* is referred to as a flushing operation, regardless of drawing of an image on the work W. In the flushing operation, there is an effect of preventing functional liquid which stays in nozzles 37*a* and 37*b* (refer to FIG. 3) from curing in the nozzles 37*a* and 37*b*. The flushing unit 77 is a unit which receives functional liquid ejected from the first to third ejecting heads 33*a*, 33*b*, and 33*c* in the flushing operation.

The capping unit 76 is a unit which puts a lid on the first to third ejecting heads 33*a*, 33*b*, and 33*c*. There is a case in which, in the functional liquid which is ejected from the first to third ejecting heads 33*a*, 33*b*, and 33*c*, liquid components are evaporated. In general, when the liquid components in the functional liquid are evaporated, viscosity of the functional liquid becomes high. When the viscosity of the functional liquid in the first to third ejecting heads 33*a*, 33*b*, and 33*c* becomes high, a function of ejecting droplets D (refer to FIG. 4) (hereinafter, referred to as ejecting performance) in the nozzles 37*a* and 37*b* decreases. As an examples of a decrease in the ejecting function, there is, for example, curving of a travelling direction of the droplets D which are ejected from the nozzles 37*a* and 37*b* (curved flight), non-ejection of the droplets D from the nozzles 37*a* and 37*b* (ejection failure), or the like. In addition, operations of putting lids on the first to third ejecting heads 33*a*, 33*b*, and 33*c* in the capping unit 76 are referred to as capping operations.

The capping unit 76 suppresses evaporating of the liquid components of the functional liquid from the nozzle to be low by putting lids on the first to third ejecting heads 33*a*, 33*b*, and 33*c*. In this manner, it is possible to easily maintain an ejecting performance in the first to third ejecting heads 33*a*, 33*b*, and 33*c*. The wiping unit 79 is a unit which wipes the nozzle faces 35 of the first to third ejecting heads 33*a*, 33*b*, and 33*c*. In the image forming apparatus 1, the functional liquid attaches to the nozzle faces 35. When the functional liquid attaches to the nozzle faces 35, the ejecting performance in the first to third ejecting heads 33*a*, 33*b*, and 33*c* decreases. The wiping unit 79 sweeps the functional liquid which is attached to the nozzle faces 35 away by wiping the nozzle faces 35. In this manner, it is possible to easily maintain the ejecting performance in the first to third ejecting heads 33*a*, 33*b*, and 33*c*. In addition, the operation of wiping the nozzle faces 35 using the wiping unit 79 is referred to as a wiping operation.

The maintenance table 75 is configured so as to perform reciprocating in the Y axis direction by a not shown moving mechanism and a power source. As the moving mechanism, for example, it is possible to adopt a mechanism in which, for example, a ball screw and a ball nut are combined, a linear guide mechanism, or the like. In addition, according to the embodiment, as a power source for moving the maintenance table 75 along the Y axis direction, a table transport motor which will be described later is adopted. As the table transport motor, it is possible to adopt various motors such as a stepping motor, a servomotor, a linear motor, and the like. Power from the table transport motor is transmitted to the maintenance table 75 through the moving mechanism. In this manner, the maintenance table 75 can perform reciprocating along the guide rails 73*a* and 73*b*, that is, along the Y axis direction. That is, the maintenance device 11 can cause the maintenance units such as the capping unit 76, the flushing unit 77, the wiping unit 79, or the like, to perform reciprocating along the Y axis direction. In this manner, it is possible to make the first to third ejecting heads 33*a*, 33*b*, and 33*c* face the capping unit 76, the flushing unit 77, and the wiping unit 79, respectively, in a state in which the first to third ejecting heads 33*a*, 33*b*, and 33*c* are overlapped with the maintenance device 11 when viewed planarly.

Figure 2:
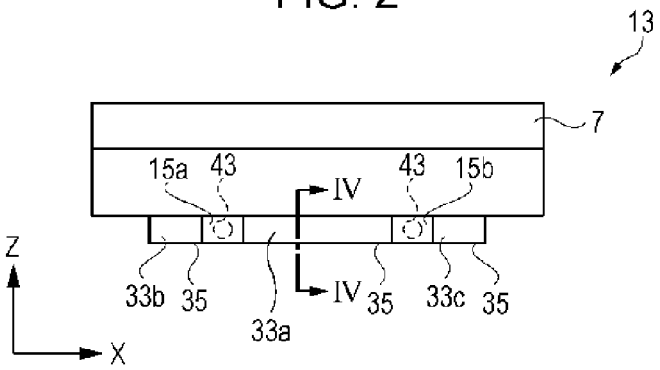
FIG. 2 is a schematic diagram which illustrates a configuration of a head unit.
Figure 3:
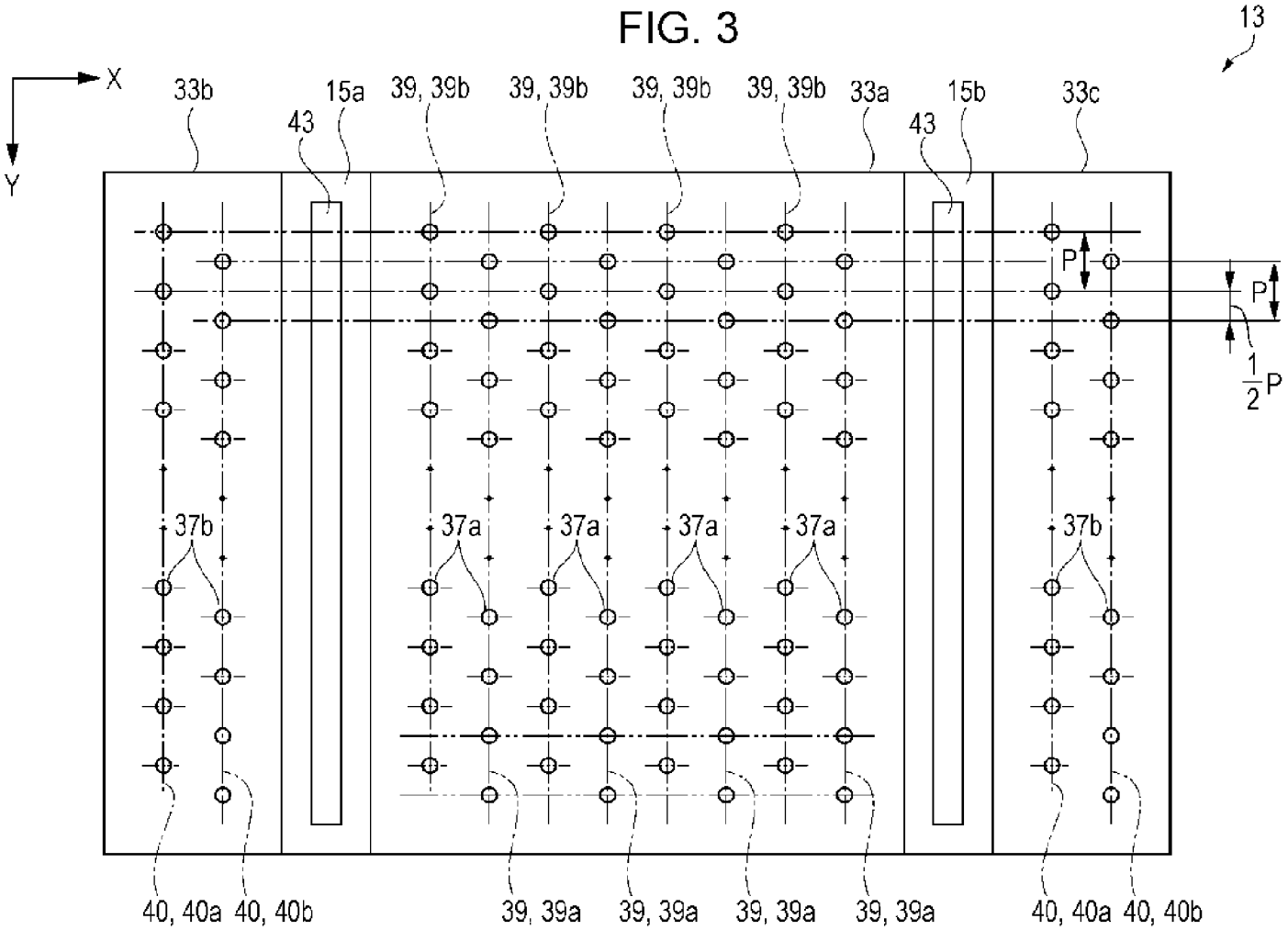
FIG. 3 is a plan view which illustrates the configuration of a head unit.

Subsequently, a configuration of the head unit will be described. FIG. 2 is a schematic diagram which illustrates the configuration of the head unit, and FIG. 3 is a plan view which illustrates the configuration of the head unit. In addition, FIG. 2 is a front view when viewing the carriage 7 in the II direction in FIG. 1. As illustrated in FIGS. 2 and 3, the head unit 13 includes the first ejecting head 33*a* ejecting the photo-curable color ink which is cured by being irradiated with light, the second ejecting head 33*b* ejecting photo-curable transparent ink which is cured by being irradiated with light, and the first light irradiation unit 15*a* which radiates light to the ejected color ink or transparent ink. According to the embodiment, the third ejecting head 33*c* ejecting photo-curable transparent ink which is cured by being irradiated with light, and the second light irradiation unit 15*b* which radiates light to the ejected color ink or transparent ink are further included.

In addition, as illustrated in FIGS. 2 and 3, the second ejecting head 33*b* is arranged in the reciprocating direction of the first ejecting head 33*a* (X axis direction), the first light irradiation unit 15*a* is arranged between the first ejecting head 33*a* and the second ejecting head 33*b*, the third ejecting head 33*c* is arranged on a side which is opposite to an arranging position of the second ejecting head 33*b* with respect to the first ejecting head 33*a* in the reciprocating direction, and the second light irradiation unit 15*b* is arranged between the first ejecting head 33*a* and the third ejecting head 33*c*. In addition, color ink according to the embodiment is ink including a coloring agent, and the transparent ink is ink not including the coloring agent. In addition, the color ink and the transparent ink according to the embodiment is ink of which curing is promoted by being irradiated with ultraviolet light.

The first and second light irradiation units 15*a* and 15*b* respectively include light sources 43 emitting ultraviolet light toward ink which is applied onto the work W. In color ink and transparent ink which receive the ultraviolet light, curing is promoted by being irradiated with ultraviolet light from the light source 43. As the light source 43, for example, it is possible to adopt various light sources 43 such as an LED, an LD, a mercury lamp, a metal-halide lamp, a xenon lamp, and an excimer lamp.

In addition, as illustrated in FIG. 3, a nozzle column 39 in which a plurality of nozzles 37*a* are arranged is arranged in the first ejecting head 33*a*. According to the embodiment, the plurality of nozzles 37*a* which eject color ink are arranged along the Y axis direction, and configure a plurality of nozzle columns 39*a* and 39*b*. The plurality of nozzles 37*a* in each of the nozzle columns 39*a* and 39*b* are formed with a predetermined nozzle interval P along the Y axis direction. In addition, in the direction of the nozzle columns 39*a* and 39*b*, a nozzle 37*a* of the nozzle column 39*a*, and a nozzle 37*a* of the nozzle column 39*b* are arranged by being shifted by a half a distance of (P/2) of the interval P.

In addition, according to the embodiment, as illustrated in FIG. 3, the nozzle columns 39*a* and 39*b* are alternately aligned in four columns, respectively, in a state of leaving intervals between each other in the X axis direction. In this case, for example, respective color inks of cyan, magenta, yellow, and black as the color ink are configured so as to appropriately correspond to the respective nozzle columns 39*a* and 39*b*. In addition, the color ink is not limited to four colors, may be three colors or less, and may be five colors or more. In this case, the number of columns of the nozzle columns 39*a* and 39*b* may be appropriately set according to the number of color inks.

In addition, a nozzle column 40 in which a plurality of nozzles 37*b* are arranged is arranged in the second ejecting head 33*b*. According to the embodiment, the plurality of nozzles 37*b* which eject transparent ink are arranged along the Y axis direction, and configure one nozzle column 40*a* and one nozzle column 40*b*, respectively. The plurality of nozzles 37*a* in each of the nozzle columns 40*a* and 40*b* are formed with a predetermined nozzle interval P along the Y axis direction. In addition, in the direction of the nozzle columns 40*a* and 40*b*, a nozzle 37*b* of the nozzle column 40*a*, and a nozzle 37*b* of the nozzle column 40*b* are arranged by being shifted by a distance of a half (P/2) of the interval P. In addition, in the second ejecting head 33*b* according to the embodiment, two columns of nozzle columns 40*a* and 40*b* are arranged, however, the number of columns is not limited to this, and may be one column, or may be three columns or more. In addition, since a configuration of the third ejecting head 33*c* is the same as that of the second ejecting head 33*b*, descriptions thereof will be omitted.

Figure 4:
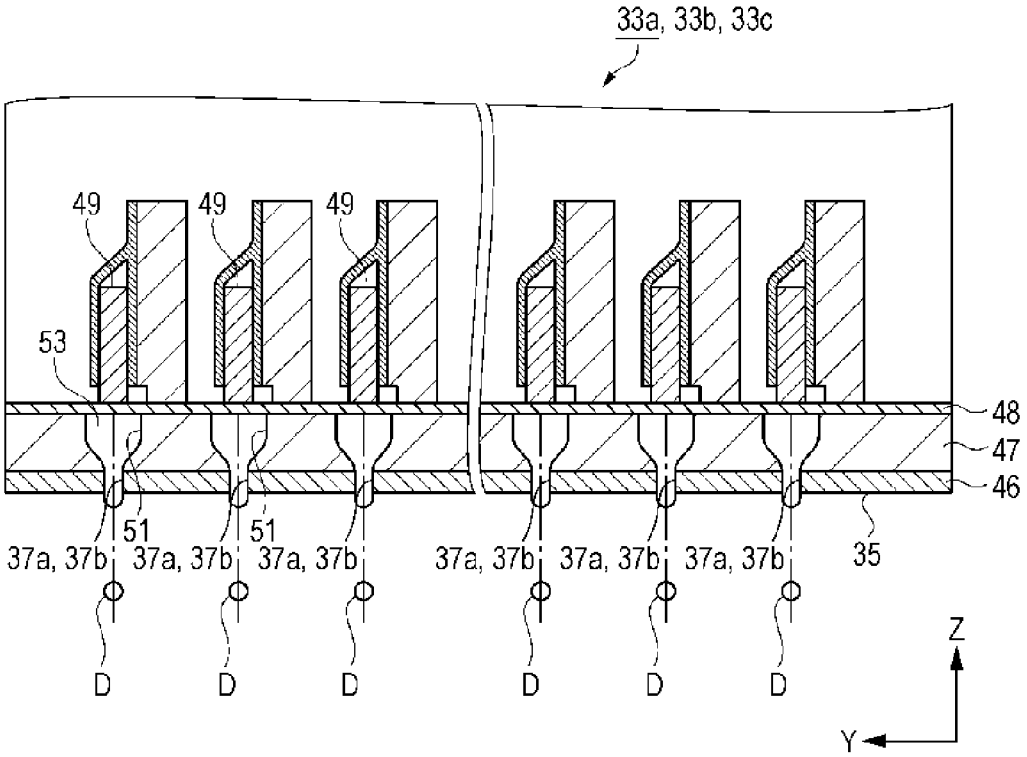
FIG. 4 is a cross-sectional view which illustrates a configuration of an ejecting unit.

Subsequently, a configuration of the ejecting head will be described. FIG. 4 is a cross-sectional view (cross-sectional view which is taken along line IV-IV in FIG. 2) which illustrates a configuration of an ejecting head. As illustrated in FIG. 4, the first ejecting head 33*a* includes a nozzle plate 46, a cavity plate 47, a vibrating plate 48, and a plurality of piezoelectric elements 49. The nozzle plate 46 includes a nozzle face 35. In addition, the nozzle plate 46 is provided with the plurality of nozzles 37*a*. The cavity plate 47 is provided on a face which is a side opposite to the nozzle face 35 of the nozzle plate 46. A plurality of cavities 51 are formed on the cavity plate 47. Each of the cavities 51 is provided corresponding to each of the nozzle 37*a* and 37*b*, and communicates with each corresponding nozzle 37*a*. Functional liquid 53 is supplied to each of the cavities 51 from a not shown tank.

The vibrating plate 48 is provided on a face which is a side opposite to the nozzle plate 46 side of the cavity plate 47. The vibrating plate 48 enlarges or contracts a capacity in the cavity 51 by being vibrated in the Z direction (vertical vibration). The plurality of piezoelectric elements 49 are provided on a face which is the opposite side to the cavity plate 47 side of the vibrating plate 48, respectively. Each piezoelectric element 49 is provided corresponding to each cavity 51, and faces each cavity 51 by interposing the vibrating plate 48 therebetween. Each piezoelectric element 49 extends based on a driving signal. In this manner, the vibrating plate 48 contracts the capacity in the cavity 51. At this time, the functional liquid 53 in the cavity 51 is applied with pressure. As a result, color ink as the functional liquid 53 is ejected as droplets D from the nozzle 37*a*.

In addition, according to the embodiment, the vertical vibrating-type piezoelectric element 49 is adopted, however, a unit for pressurizing for applying pressure to the functional liquid 53 is not limited to this, and, for example, it is also possible to adopt a piezoelectric element of a bending deformation-type which is formed by laminating a lower electrode, a piezoelectric layer, and an upper electrode. In addition, as the unit for pressurizing, it is also possible to adopt a so-called electrostatic actuator, or the like, in which droplets are ejected from a nozzle by generating static electricity between a vibrating plate and an electrode, and by transforming the vibrating plate using an electrostatic force. In addition, it is also possible to adopt a configuration in which bubbles are generated in a nozzle using a heating body, and applies pressure to functional liquid using the bubbles. In addition, since configurations of the second and third ejecting heads 33*b* and 33*c* are the same as that in the above described first ejecting head 33*a*, descriptions thereof will be omitted. In addition, in the second and third ejecting heads 33*b* and 33*c*, transparent ink as the functional liquid 53 is ejected as the droplets D from the nozzle 37*b*.

Figure 5:
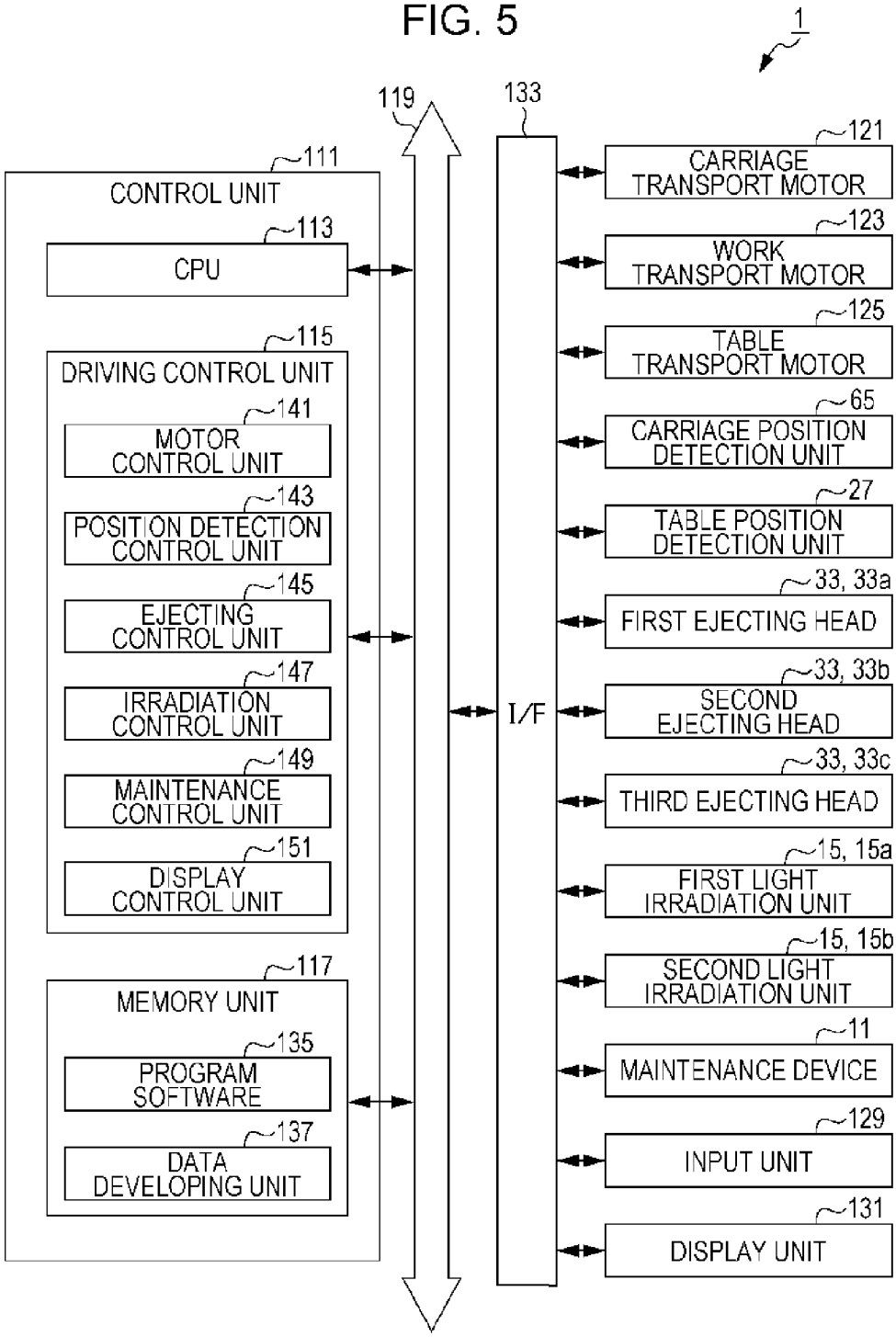
FIG. 5 is a block diagram which illustrates a configuration of a controller of the image forming apparatus.

Subsequently, a configuration of the controller of the image forming apparatus will be described. FIG. 5 is a block diagram which illustrates the configuration of the controller of the image forming apparatus. As illustrated in FIG. 5, the image forming apparatus 1 includes a controller 111 which controls operations of each of the configuring units. The controller 111 includes a Central Processing Unit (CPU) 113, a driving controller 115, and a memory unit 117. The driving controller 115 and the memory unit 117 are connected to the CPU 113 through a bus 119. In addition, the image forming apparatus 1 includes a carriage transport motor 121 as a moving unit which moves the carriage 7 (head unit 13) in a reciprocating movement in the X axis direction with respect to the work W, a work transport motor 123, a table transport motor 125, an input unit 129 and a display unit 131. The carriage transport motor 121, the work transport motor 123, and the table transport motor 125 are connected to the controller 111 through an input/output interface 133 and the bus 119, respectively. In addition, the input unit 129 and the display unit 131 are also connected to the controller 111 through the input/output interface 133 and the bus 119, respectively.

The carriage transport motor 121 generates power for driving the carriage 7. The work transport motor 123 generates power for driving the work table 25. The table transport motor 125 generates power for driving the maintenance table 75. The input unit 129 is a unit for inputting various machining conditions. The display unit 131 is a unit for displaying machining conditions, or working situations. An operator who operates the image forming apparatus 1 is able to input various pieces of information through the input unit 129 while checking information which is displayed on the display unit 131. In addition, a carriage position detection unit 65, a table position detection unit 27, and the three first to third ejecting heads 33*a*, 33*b*, and 33*c* are respectively connected to the controller 111 through the input/output interface 133 and the bus 119. In addition, the two first and second light irradiation units 15*a* and 15*b*, and the maintenance device 11 are also connected to the controller 111 through the input/output interface 133 and the bus 119, respectively.

The CPU 113 performs various arithmetic processes as a processor. The driving controller 115 controls driving in each configuration. The memory unit 117 includes a Random Access Memory (RAM), a Read Only Memory (ROM), or the like. In the memory unit 117, a data developing unit 137, or the like, which is a region for storing program software 135 in which a controlling procedure of operations in the image forming apparatus 1 is described, or a region in which various data items are temporarily developed is set. As the data which is developed in the data developing unit 137, for example, there is drawing data by which an image to be drawn is illustrated, program data for drawing processes, or the like. The driving controller 115 includes a motor controller 141, a position detection controller 143, an ejection controller 145, an irradiation controller 147, a maintenance controller 149, and a display controller 151.

The motor controller 141 individually controls driving of the carriage transport motor 121, driving of the work transport motor 123, and driving of the table transport motor 125 based on a command from the CPU 113. The position detection controller 143 individually controls the carriage position detection unit 65 and the table position detection unit 27 based on a command from the CPU 113. The position detection controller 143 causes the carriage position detection unit 65 to detect a position of the carriage 7 in the X axis direction based on a command from the CPU 113, and outputs a detection result to the CPU 113. In addition, the position detection controller 143 causes the table position detection unit 27 to detect a position of the work table 25 in the Y axis direction based on a command from the CPU 113, and outputs a detection result to the CPU 113.

The ejection controller 145 controls respective driving of the first to third ejecting heads 33*a*, 33*b*, and 33*c* based on a command from the CPU 113. The irradiation controller 147 individually controls a light emission state of the light source 43 in each of the first and second light irradiation units 15*a* and 15*b* based on a command from the CPU 113. The maintenance controller 149 individually controls driving of the maintenance units such as the capping unit 76, the flushing unit 77, and the wiping unit 79 in the maintenance device 11 based on a command from the CPU 113. The display controller 151 controls driving of the display unit 131 based on a command from the CPU 113.

Figure 6A:
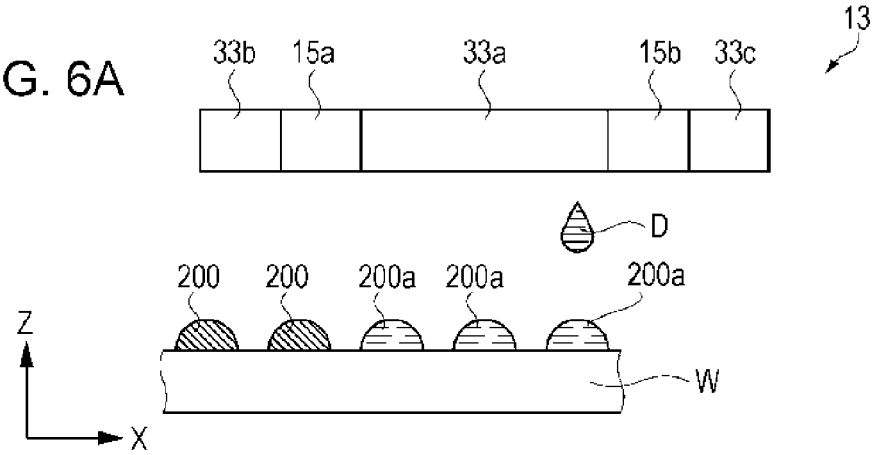
FIGS. 6A to 6C are schematic diagrams which illustrate a control method of the image forming apparatus.
Figure 6B:
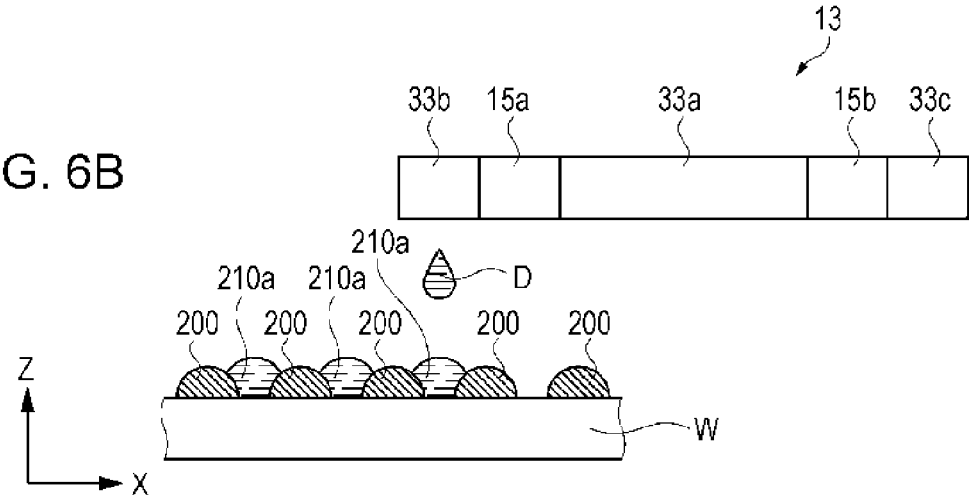
Figure 6C:
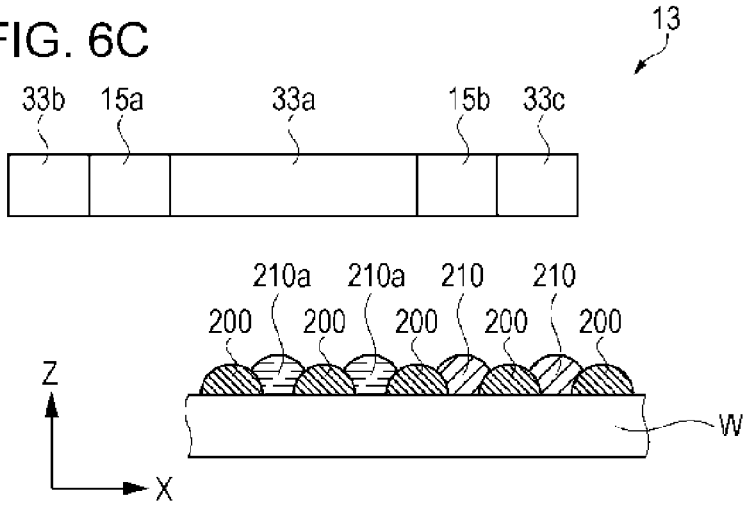
Figure 7A:
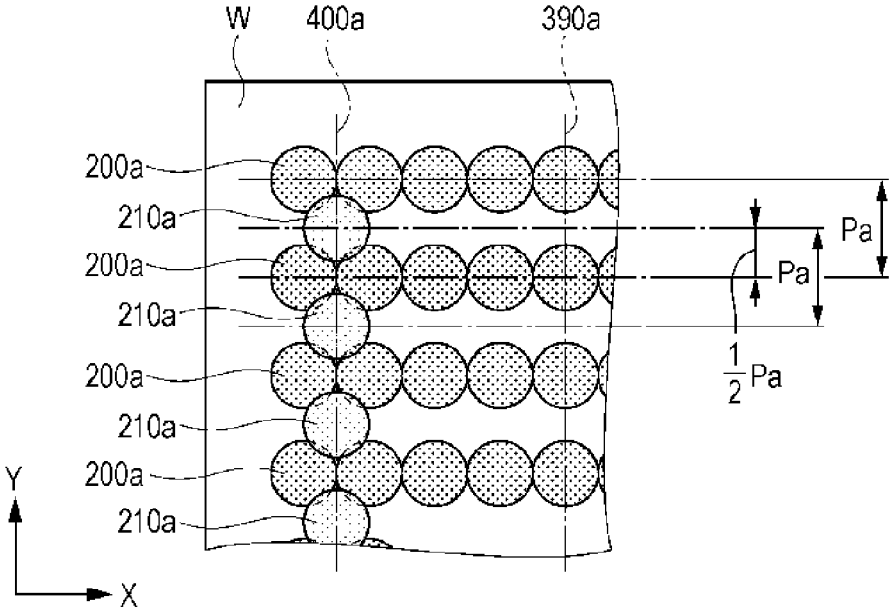
FIGS. 7A and 7B are explanatory diagrams which illustrate an image forming method.
Figure 7B:
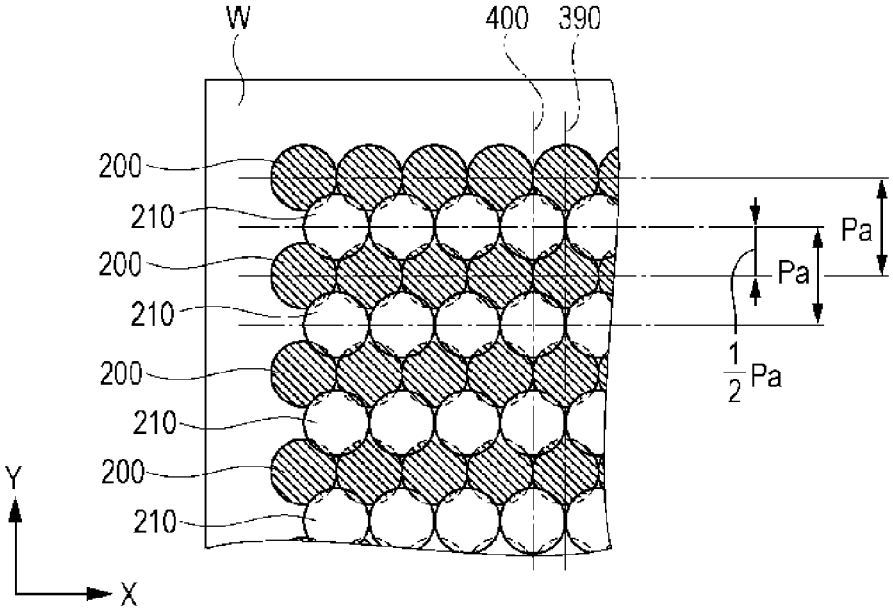

Subsequently, a control method of the image forming apparatus will be described. FIGS. 6A to 6C are schematic diagrams which illustrate a control method of the image forming apparatus, and FIGS. 7A and 7B are explanatory diagrams which illustrate an image forming method. In the control method of the image forming apparatus, color ink is ejected toward a recording medium while moving the head unit in one direction in reciprocating movements of the head unit, the color ink which is applied onto the recording medium is irradiated with light, transparent ink is ejected onto the recording medium after that, and light is radiated to the transparent ink which is applied in the one direction while moving the head unit in the other direction in reciprocating movements. Hereinafter, the method will be described in detail. In addition, in the embodiment, a case in which an image is formed using the above described image forming apparatus 1 will be described.

First, a control method in which an image is formed (drawn) on the work W while causing the head unit 13 to perform reciprocating (first path) in the positive X axis direction with respect to the work W as a recording medium will be described. In this case, driving of the first and second ejecting heads 33*a* and 33*b*, and the first light irradiation unit 15*a* is controlled. At this time, in arrangements of the first and second ejecting heads 33*a* and 33*b*, and the first light irradiation unit 15*a*, the first ejecting head 33*a* is arranged furthest upstream, the first light irradiation unit 15*a* is arranged on the downstream side of the first ejecting head 33*a*, and the second ejecting head 33*b* is arranged on the downstream side of the first light irradiation unit 15*a* in the positive X axis direction.

In addition, as illustrated in FIGS. 6A and 7A, first, color ink is ejected as the droplets D from the nozzle 37*a* of the nozzle column 39*a* of the first ejecting head 33*a* (refer to FIG. 3) toward the work W, while causing the first ejecting head 33*a* to move forward in the positive X axis direction (first path), and the first ink dot column 390*a* is formed by arranging (applying) ink dots 200*a* of the color ink on the work W.

In addition, according to the embodiment, the first ink dot column 390*a* is formed along the Y axis direction corresponding to the nozzle column 39*a*. In addition, the ink dots 200*a* in the first ink dot column 390*a* are arranged, for example, with a predetermined nozzle interval Pa along the Y axis direction.

Subsequently, ultraviolet light is radiated to the ink dots 200*a* which are applied to the work W from the first light irradiation unit 15*a*. In this manner, the ink dots 200*a* are cured, and the color ink 200 is fixed.

Subsequently, as illustrated in FIGS. 6B and 7A, transparent ink is ejected as the droplets D from the nozzle 37*b* of the nozzle columns 40*a* of the second ejecting head 33*b* (refer to FIG. 3) toward the work W, and the second ink dot column 400*a* is formed by arranging (applying) ink dots 210*a* of the transparent ink on the work W. In addition, according to the embodiment, the second ink dot column 400*a* is formed along the Y axis direction corresponding to the nozzle column 40*a*. In addition, the ink dots 210*a* in the second ink dot column 400*a* are arranged, for example, with a predetermined nozzle interval Pa along the Y axis direction. In addition, it is possible to appropriately set a size, or the like, of the ink dots 210*a* of the transparent ink. Here, the ink dots 200*a* of the first ink dot column 390*a*, and the ink dots 210*a* of the second ink dot column 400*a* are arranged by being shifted in the column directions of the first and second ink dot columns 390*a* and 400*a*. According to the embodiment, the ink dots are arranged by being shifted by a distance of a half (Pa/2) of the interval Pa between the nozzles. The arranged ink dots 210*a* of the transparent ink are spread by being wet between the cured color ink 200.

Subsequently, a control method in a case in which an image is formed (drawn) on the work W while causing the head unit 13 to make a backward movement (second path) in the negative X axis direction with respect to the work W will be described. In this case, driving of the first and third ejecting head 33*a* and 33*c*, and the second light irradiation unit 15*b* is controlled. At this time, in arrangements of the first and third ejecting head 33*a* and 33*c*, and the second light irradiation unit 15*b*, the first ejecting head 33*a* is arranged furthest upstream, the second light irradiation unit 15*b* is arranged on the downstream side of the first ejecting head 33*a*, and the third ejecting head 33*c* is arranged on the downstream side of the second light irradiation unit 15*b* in the negative X axis direction.

In addition, the first ink dot column 390*a* is formed by causing the color ink to be ejected as the droplets D from the nozzles 37*a* of the nozzle columns 39*a* and 39*b* of the first ejecting head 33*a* (refer to FIG. 3) toward the work W while causing the first ejecting head 33*a* to make a forward movement(scanning) in the negative X axis direction, and causing the ink dots 200*a* of the color ink to be arranged (applied) on the work W, similarly to the first path.

Subsequently, as illustrated in FIGS. 6C and 7B, ultraviolet light is radiated to the ink dots 200*a* of the color ink which is applied to the work W, and the ink dots 210*a* of the transparent ink which is applied in the first path from the second light irradiation unit 15*b*. In this manner, the ink dots 200*a* and 210*a* are cured, and the color ink 200 in the second path, and the transparent ink 210 in the first path are fixed. That is, the ink dots 210*a* of the transparent ink are not cured in the first path in which the transparent ink is applied, and are cured in the subsequent second path.

In addition, the transparent ink is also ejected as the droplets D from the third ejecting head 33*c* in the second path, and the ink dots 210*a* are arranged on the work W. In this manner, the arranged ink dots 210*a* of the transparent ink are spread by being wet between the cured color ink 200.

Hereinafter, reciprocating of the head unit 13 is repeated, and the above described same control is performed. In this manner, it is possible to form a desired image.

As described above, according to the embodiment, it is possible to obtain the following effects.

In the process of causing the head unit 13 to perform reciprocating, first, the color ink is applied in the first path, and the ink dots 200*a* of the applied color ink are cured by being irradiated with ultraviolet light. In addition, the transparent ink is applied between the cured color ink 200. Subsequently, ultraviolet light is radiated to the transparent ink which is applied in the second path. Due to this, the ink dots 210*a* of the transparent ink are cured. That is, the transparent ink which is applied in the first path is not cured in the first path, and is cured in the second path. Accordingly, the transparent ink is spread by being wet between concave portions of cured color ink 200 while the transparent ink is cured after being applied onto the work W. In addition, the transparent ink is cured in a state of being spread and being wet. In this manner, it is possible to easily reduce generation of irregularity on the surface, and to form a high quality image.

In addition, the invention is not limited to the above described embodiments, and it is possible to add various changes and modifications to the above described embodiments. Modification examples will be described below.

MODIFICATION EXAMPLE 1

In the above described embodiments, first, the color ink is caused to be ejected as the droplets D from the nozzles 37*a* of the nozzle columns 39*a* of the first ejecting head 33*a* (refer to FIG. 3) toward the work W while causing the first ejecting head 33*a* to make a forward movement in the positive X axis direction (first path), the transparent ink is caused to be ejected as the droplets D from the nozzles 37*b* of the nozzle columns 40*a* of the second ejecting head 33*b* (refer to FIG. 3) after that, and the ink dots 200*a* of the color ink and the ink dots 210*a* of the transparent ink are arranged by being shifted by a distance of a half of Pa in the Y axis direction, however, it is not limited to this. It is possible to appropriately change so that the ink dots 200*a* of the color ink and the ink dots 210*a* of the transparent ink are arranged by being almost overlapped with each other in the Y axis direction, or the like, by causing the color ink to be ejected as the droplets D from the nozzles 37*a* of the nozzle columns 39*a* and 39*b* of the first ejecting head 33*a* (refer to FIG. 3) toward the work W, first, and then causing the transparent ink to be ejected as the droplets D from the nozzles 37*b* of the nozzle columns 40*a* and 40*b* of the second ejecting head 33*b* (refer to FIG. 3).

MODIFICATION EXAMPLE 2

According to the embodiment, the ultraviolet light is radiated from the first light irradiation unit 15*a* at the time of forward movement in the positive X axis direction (first path), and the ultraviolet light is radiated from the second light irradiation unit 15*b* at the time of backward movement in the negative X axis direction (second path), however, it is not limited to this. The ultraviolet light may be radiated from both the first and second light irradiation units 15*a* and 15*b* in both the reciprocating operations in the positive and negative X axis directions, or in one of the reciprocating operations.

Particularly, in the embodiment, in a case in which the ultraviolet light is radiated from both the first and second light irradiation units 15*a* and 15*b*, at the time of backward movement in the negative X axis direction (second path), since the ink dots 210*a* of the transparent ink which is applied in the first path are cured, first, by the ultraviolet light radiated from the first light irradiation unit 15*a*, and then the ink dots 200*a* of the color ink in the second path are applied onto the work W, the ink dots 210*a* of the transparent ink which is applied in the first path, and the ink dots 200*a* of the color ink which is applied in the second path are not mixed. Accordingly, when the light irradiation unit is controlled in this manner, there is an effect of preventing an adverse effect due to mixing of the ink dots of the transparent ink and ink dots of the color ink.

MODIFICATION EXAMPLE 3

According to the embodiment, the color ink is applied in the first path, and the ink dots 200*a* of the applied color ink are cured by being irradiated with ultraviolet light. In addition, the transparent ink is applied between the cured color ink 200. Subsequently, the transparent ink which is applied in the second path is irradiated with the ultraviolet light. In this manner, the ink dots 210*a* of the transparent ink are cured, however, it is not limited to this, and the color ink is applied in the first path, and the ink dots 200*a* of the applied color ink are cured by being irradiated with the ultraviolet light. In addition, the transparent ink is applied between the cured color ink 200, or on the color ink 200 in the second path, and subsequently, the ultraviolet light is radiated to the applied transparent ink in the third path (forward movement). That is, the transparent ink which is applied in the second path is not cured in the second path, and is cured in the third path. Accordingly, the transparent ink is spread by being wet between the concave portions of the cured color ink 200. In addition, the transparent ink is cured in a state of being spread and being wet. Accordingly, it is possible to easily reduce generation of irregularity on the surface, and to form a high quality image by adopting such a method. In addition, when adopting such a method, it is possible to embody the invention with a head unit configuration which is illustrated in FIGS. 8 and 9, even though it is not the head unit configuration illustrated in FIGS. 2 and 3 in which the first light irradiation unit 15*a* is arranged between the first ejecting head 33*a* and the second ejecting head 33*b*.

Figure 8:
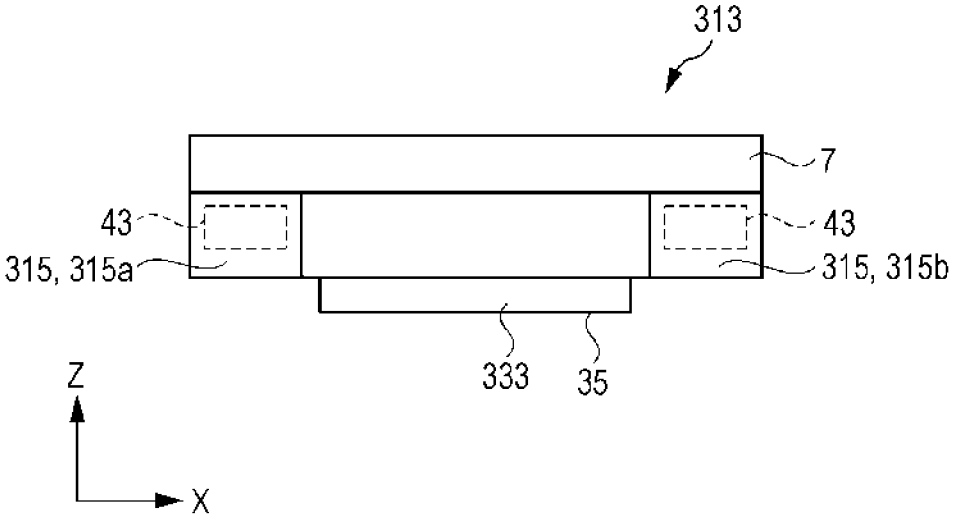
FIG. 8 is a schematic diagram which illustrates a configuration of a head unit according to Modification Example 3.

FIG. 8 is a schematic diagram which illustrates a configuration of a head unit according to the Modification Example 3. In addition, similarly to FIG. 2, FIG. 8 is a front view when viewing the carriage 7 in the VIII direction in FIG. 1. As illustrated in FIG. 8, a head unit 313 includes an ejecting head 333 and a light irradiation unit 315. That is, light irradiation units 315*a* and 315*b* are arranged at respective both sides of the ejecting head 333 in the reciprocating direction (X axis direction) in the embodiment. In addition, as illustrated in FIG. 9, a first nozzle column 339 on which a plurality of nozzles 337*a* ejecting color ink are arranged, and a second nozzle column 340 which is arranged in parallel to the first nozzle column, and on which a plurality of nozzles 337*b* ejecting transparent ink are arranged are provided on a nozzle plate 346 of the ejecting head 333. In addition, in the Modification Example, a plurality of first nozzle columns 339*a*, and two second nozzle columns 340*a* and 340*b* are included. In addition, nozzles 337*a* of the first nozzle column 339*a*, and nozzles 337*b* of the second nozzle columns 340*a* and 340*b* are arranged by being shifted in directions of the first nozzle column 339*a*, and the second nozzle columns 340*a* and 340*b* (Y axis direction in the embodiment).

Figure 9:
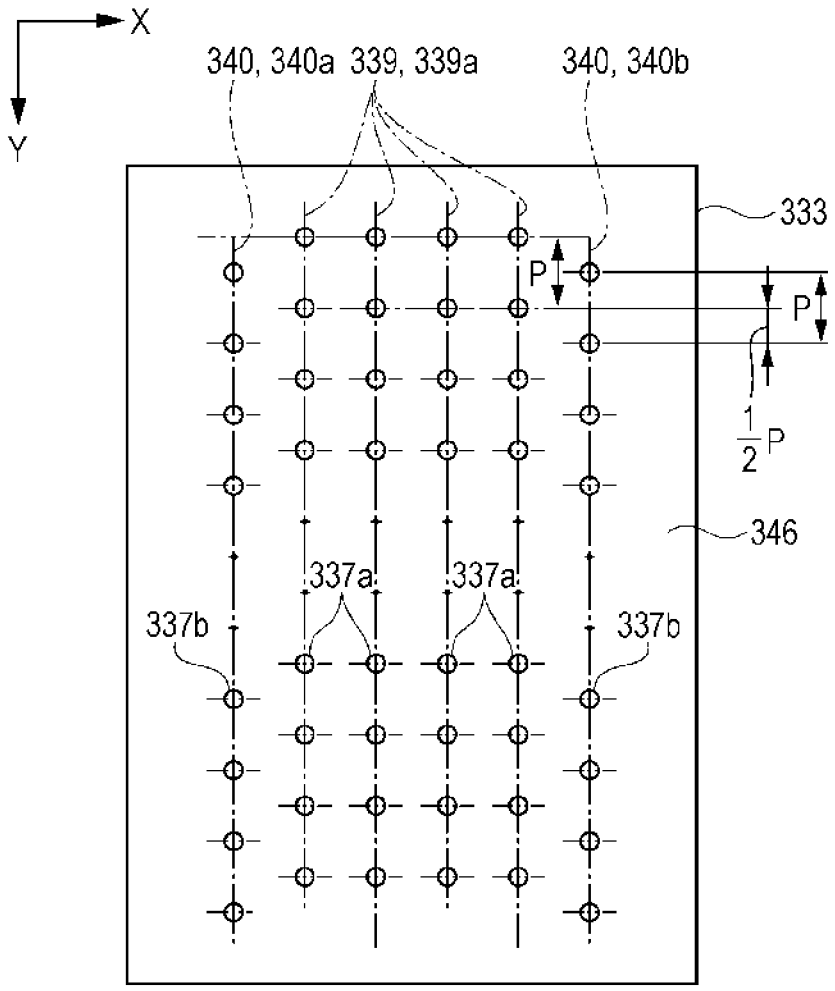
FIG. 9 is a plan view which illustrates a configuration of an ejecting unit according to Modification Example 3.

When adopting the head unit configuration which is illustrated in FIGS. 8 and 9 (refer to FIGS. 7A and 7B), color ink is applied by the nozzles 337*a* of the first nozzle column 339*a* in the first path (positive X axis direction), and the ink dots 200*a* of the applied color ink are cured by being irradiated with ultraviolet light from the light irradiation unit 315*a*. In addition, transparent ink is applied between the color ink 200 which is cured in the second path (negative X axis direction) by the second nozzle column 340*a*, or 340*b*. Subsequently, the transparent ink which is applied in the third path is irradiated with ultraviolet light by the light irradiation unit 315*a*, or 315*b*. That is, the transparent ink which is applied in the second path is not cured in the second path, and is cured in the third path. Accordingly, the transparent ink is spread by being wet between the concave portions of the cured color ink 200. In addition, the transparent ink is cured in a state of being spread and being wet. Accordingly, it is possible to easily reduce generation of irregularity on the surface, and to form a high quality image by adopting such a method.

MODIFICATION EXAMPLE 4

Figure 10:
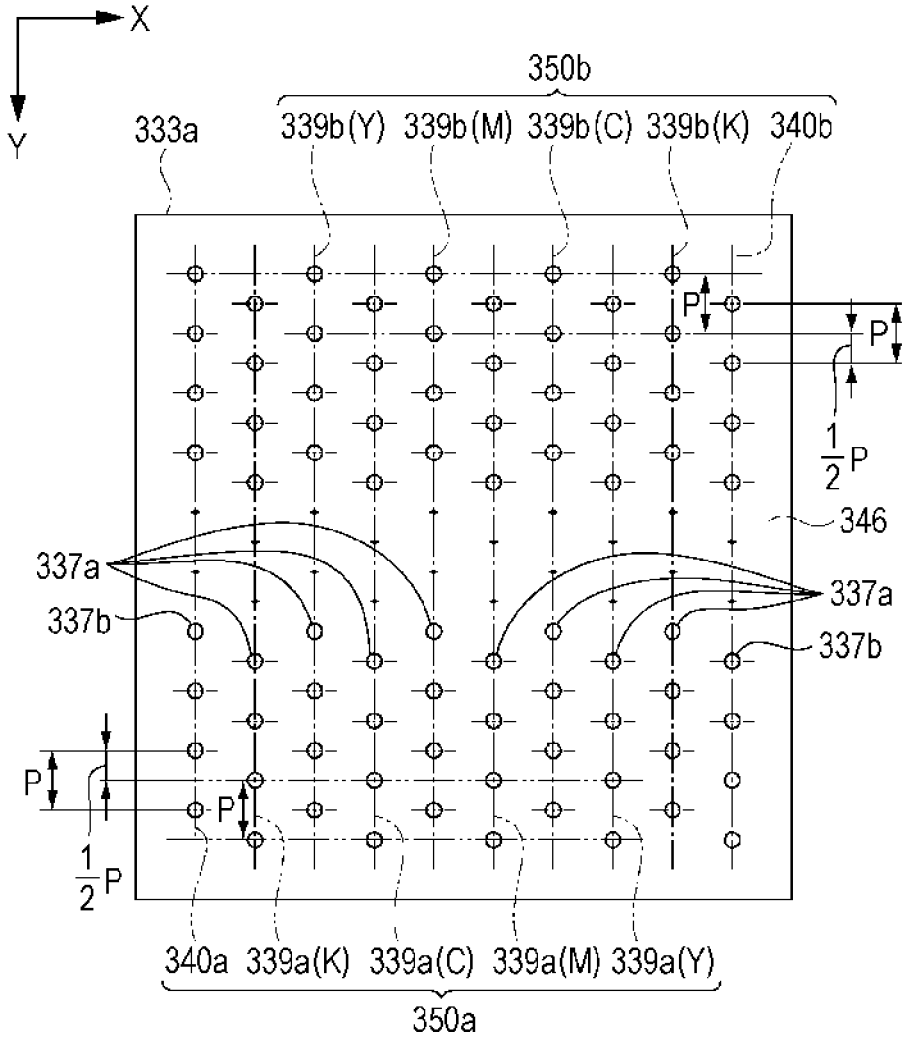
FIG. 10 is a plan view which illustrates a configuration of an ejecting unit according to Modification Example 4.

In the Modification Example 3, the ejecting head 333 which includes a group of first nozzle columns 339*a* is mounted, however, the configuration is not limited to this. For example, a plurality of groups of the first nozzle columns 339*a* may be included. FIG. 10 is a plan view which illustrates a configuration of an ejecting head according to Modification Example 4. An image forming apparatus according to the Modification Example includes first and second nozzle columns, and an ejecting head which can perform reciprocating in a direction which crosses the column directions of the first and second nozzle columns, and the ejecting head includes a first nozzle column group including a first nozzle column which is arranged on the upstream side, and a second nozzle column which is arranged on the downstream side of the first nozzle column with respect to one movement direction in reciprocating directions, and a second nozzle column group including the first nozzle column which is arranged on the upstream side, and the second nozzle column which is arranged on the downstream side of the first nozzle column with respect to the other movement direction in the reciprocating directions, and in which color arrangements of color ink on the first nozzle column in each movement direction of the first nozzle column group and the second nozzle column group are the same.

Specifically, as illustrated in FIG. 10, the ejecting head 333*a* is configured so as to perform reciprocating in the X axis direction, and the first nozzle column 339*a* and the second nozzle column 340*a* are arranged along the Y axis direction. In addition, a first nozzle column group 350*a* including the first nozzle column 339*a* which is arranged on the upstream side, and the second nozzle column 340*a* which is arranged on the downstream side of the first nozzle column 339*a* with respect to the positive X axis direction in the reciprocating directions in the X axis direction is arranged. In addition, a second nozzle column group 350*b* including the first nozzle column 339*b* which is arranged on the upstream side, and the second nozzle column 340*b* which is arranged on the downstream side of the first nozzle column 339*b* with respect to the negative X axis direction in the reciprocating directions in the X axis direction is arranged.

According to the Modification Example, in the first nozzle columns 339*a* of the first nozzle column group 350*a*, four of the first nozzle columns 339*a* are arranged with a uniform interval in the X axis direction. In addition, colors of the color ink of, for example, yellow (339*a* (Y)), magenta (339*a* (M)), cyan (339*a* (C)), and black (339*a* (K)) are arranged in this order from the upstream side to the downstream side with respect to the positive X axis direction. In addition, similarly, in the first nozzle columns 339*b* of the second nozzle column group 350*b*, four of the first nozzle columns 339*a* are arranged with a uniform interval in the X axis direction. In addition, colors of the color ink of, for example, yellow (339*b* (Y)), magenta (339*b* (M)), cyan (339*b* (C)), and black (339*b* (K)) are arranged in this order from the upstream side to the downstream side with respect to the negative X axis direction. In this manner, it is possible to make a hue approximately the same in the positive X axis direction and the negative X axis direction. In this manner, it is possible to form an image of higher quality.

In addition, according to the Modification Example, the first nozzle columns 339*a* of the first nozzle column group 350*a*, and the first nozzle columns 339*b* of the second nozzle column group 350*b* are alternately arranged with respect to the reciprocating direction. In addition, the second nozzle column 340*a* of the first nozzle column group 350*a*, and the second nozzle column 340*b* of the second nozzle column group 350*b* are respectively arranged at an end portion of the ejecting head 333*a* with respect to the reciprocating direction. According to the configuration, it is possible to reduce the ejecting head 333*a* in size in the reciprocating direction.

MODIFICATION EXAMPLE 5

According to the embodiment, or the Modification Examples, a configuration in which the plurality of nozzle columns (twelve in FIG. 3, six in FIG. 9, and ten in FIG. 10) are formed on the nozzle plate of the same ejecting head as illustrated in FIGS. 3, 9, and 10 has been described, however, it is not limited to this configuration. It is possible to obtain the same effect as that in the examples even when a head unit is configured so that, for example, a plurality of ejecting heads having one or two nozzle columns are aligned, and a relative position between ejecting heads is adjusted and fixed such that a relative position in each nozzle column direction becomes the same as those which are illustrated in FIGS. 3, 9, and 10.

MODIFICATION EXAMPLE 6

Figure 11A:
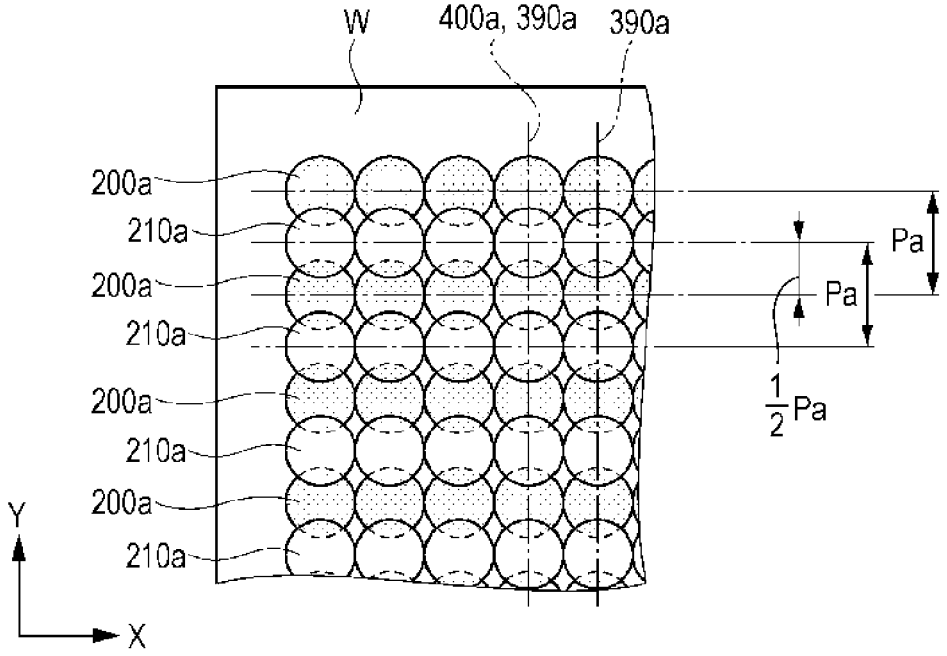
FIGS. 11A and 11B are explanatory diagrams which illustrate an image forming method according to Modification Example 6.
Figure 11B:
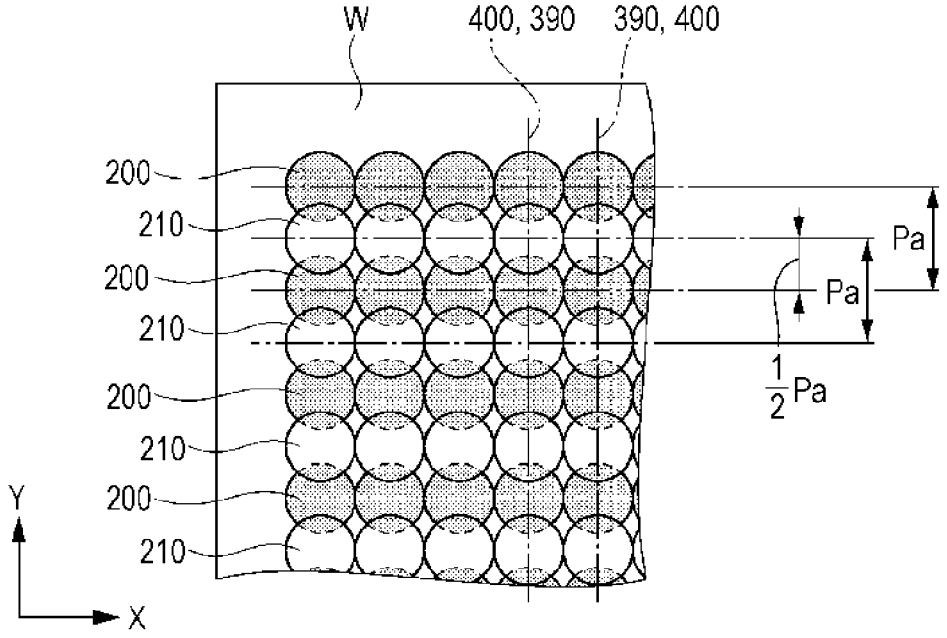

In the embodiment, the first ink dot column 390*a* of the color ink, and the second ink dot column 400*a* of the transparent ink are arranged so as to be shifted in the X axis direction in FIGS. 7A and 7B, however, it is not limited to this. It is possible to appropriately change so that the first ink dot column 390*a* and the second ink dot column 400*a* are approximately overlapped with each other as illustrated in FIGS. 11A and 11B.

The entire disclosure of Japanese Patent Application Nos: 2012-213712, filed Sep. 27, 2012, 2012-227711, filed Oct. 15, 2012, and 2013-167340, filed Aug. 12, 2013 are expressly incorporated by reference herein.

What is claimed is:

1. An image forming apparatus which forms an image on a recording medium comprising:

a head unit which includes an ejecting unit which ejects photo-curable color ink which is cured by being irradiated with light, an ejecting unit which ejects photo-curable transparent ink which is cured by being irradiated with light, and a light irradiation unit which radiates the light;

a moving unit which moves the recording medium and the head unit relatively in reciprocating movements; and a controller which causes the transparent ink to be ejected toward the recording medium while causing the head unit to move in one direction in the reciprocating movements, and causes the transparent ink which is applied in the one direction to be irradiated with the light while causing the head unit to be moved in the other direction in the reciprocating movements.

2. The image forming apparatus according to claim 1, wherein the color ink is ejected toward the recording medium while moving the head unit in the one direction, and the transparent ink is ejected toward the recording medium after radiating the light to the color ink which is applied onto the recording medium.

3. An image forming apparatus which forms an image on a recording medium comprising:

a head unit which includes an ejecting unit which ejects photo-curable color ink which is cured by being irradiated with light, an ejecting unit which ejects photo-curable transparent ink which is cured by being irradiated with light, and a light irradiation unit which radiates the light;

a moving unit which moves the recording medium and the head unit relatively in reciprocating movements; and a controller which causes the transparent ink to be ejected toward the recording medium while causing the head unit to move in one direction in the reciprocating movements, and causes the transparent ink which is applied in the one direction to be irradiated with the light while causing the head unit to be moved in the other direction in the reciprocating movements, wherein the controller causes the color ink to be ejected, ink dots to be arranged on the recording medium, and a first ink dot column to be formed, causes the transparent ink to be ejected, ink dots to be arranged on the recording medium, and a second ink dot column to be formed, and causes the ink dots of the first ink dot column and the ink dots of the second ink dot column to be arranged by shifting thereof in directions of the first and second ink dot columns.

4. An image forming apparatus which forms an image on a recording medium comprising:

a head unit which includes an ejecting unit which ejects photo-curable color ink which is cured by being irradiated with light, an ejecting unit which ejects photo-curable transparent ink which is cured by being irradiated with light, and a light irradiation unit which radiates the light;

a moving unit which moves the recording medium and the head unit relatively in reciprocating movements; and a controller which causes the transparent ink to be ejected toward the recording medium while causing the head unit to move in one direction in the reciprocating movements, and causes the transparent ink which is applied in the one direction to be irradiated with the light while causing the head unit to be moved in the other direction in the reciprocating movements, wherein the controller causes respective nozzles of first and second nozzle columns to be arranged so as to have a uniform interval, and causes the nozzles of the first and second nozzle columns to be arranged so as to be shifted by a distance of a half of the interval between the nozzles in directions of the first and second nozzle columns.

5. An image forming apparatus which forms an image on a recording medium comprising:

a head unit which includes an ejecting unit which ejects photo-curable color ink which is cured by being irradiated with light, an ejecting unit which ejects photo-curable transparent ink which is cured by being irradiated with light, and a light irradiation unit which radiates the light;

a moving unit which moves the recording medium and the head unit relatively in reciprocating movements; and a controller which causes the transparent ink to be ejected toward the recording medium while causing the head unit to move in one direction in the reciprocating movements, and causes the transparent ink which is applied in the one direction to be irradiated with the light while causing the head unit to be moved in the other direction in the reciprocating movements, wherein the head unit includes a first ejecting unit which ejects photo-curable color ink which is cured by being irradiated with light, second and third ejecting units which eject photo-curable transparent ink which is cured by being irradiated with light, and first and second light irradiation units which radiate the light, wherein the second ejecting unit is arranged in a direction of the reciprocating movement of the first ejecting unit, and the first light irradiation unit is arranged between the first and second ejecting units, and wherein the third ejecting unit is arranged on a side which is opposite to an arranging position of the second ejecting unit with respect to the first ejecting unit in the direction of the reciprocating movement, and the second irradiation unit is arranged between the first and third ejecting units.

* * * * *